US010584914B2

(12) United States Patent
Jung et al.

(10) Patent No.: US 10,584,914 B2
(45) Date of Patent: Mar. 10, 2020

(54) VACUUM ADIABATIC BODY AND REFRIGERATOR

(71) Applicant: LG ELECTRONICS INC., Seoul (KR)

(72) Inventors: Wonyeong Jung, Seoul (KR); Deokhyun Youn, Seoul (KR); Daewoong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/749,142

(22) PCT Filed: Aug. 2, 2016

(86) PCT No.: PCT/KR2016/008514
§ 371 (c)(1),
(2) Date: Jan. 31, 2018

(87) PCT Pub. No.: WO2017/023095
PCT Pub. Date: Feb. 9, 2017

(65) Prior Publication Data

US 2018/0238610 A1 Aug. 23, 2018

(30) Foreign Application Priority Data

Aug. 3, 2015 (KR) ..... 10-2015-0109623

(51) Int. Cl.
*F25D 23/06* (2006.01)
*F25D 23/02* (2006.01)
(Continued)

(52) U.S. Cl.
CPC ..... *F25D 23/066* (2013.01); *F25B 13/00* (2013.01); *F25D 23/028* (2013.01); *F25D 23/087* (2013.01); *F25D 2201/14* (2013.01)

(58) Field of Classification Search
CPC .... F25D 23/066; F25D 23/028; F25D 23/087; F25D 2201/14; F25B 13/00
See application file for complete search history.

(56) References Cited

U.S. PATENT DOCUMENTS 1,413,169 A 4/1922 Lawton
1,588,707 A 6/1926 Csiga
(Continued)

FOREIGN PATENT DOCUMENTS

CN 1132346 10/1996
CN 1191959 9/1998
(Continued)

OTHER PUBLICATIONS

European Search Report dated Feb. 13, 2019 issued in EP Application No. 16833309.4.
(Continued)

*Primary Examiner* — Melvin Jones
(74) *Attorney, Agent, or Firm* — Ked & Associates, LLP

(57) ABSTRACT

A vacuum adiabatic body includes a first plate; a second plate; a seal; a support; a heat resistance unit; and an exhaust port, wherein the heat resistance unit includes a conductive resistance sheet connected to the first plate, the conductive resistance sheet resisting heat conduction flowing along a wall for the third space, the conductive resistance sheet includes a shielding part for heat-insulating the conductive resistance sheet by shielding a first surface of the conductive resistance sheet, and a second surface of the conductive resistance sheet is heat-insulated by the third space.

20 Claims, 10 Drawing Sheets

(51) Int. Cl.
*F25D 23/08* (2006.01)
*F25B 13/00* (2006.01)

(56) References Cited

U.S. PATENT DOCUMENTS

| | | | | |
|---|---|---|---|---|
| 1,845,353 | A | 2/1932 | Snell | |
| 2,000,882 | A | 5/1935 | Comstock | |
| 2,708,774 | A | 5/1955 | Seelen | |
| 2,715,976 | A | 8/1955 | Whitmore | |
| 2,729,863 | A * | 1/1956 | Kurtz | F25D 23/062 220/592.09 |
| 2,768,046 | A * | 10/1956 | Evans | F25D 23/062 220/592.09 |
| 2,786,241 | A | 3/1957 | Garvey et al. | |
| 3,161,265 | A | 12/1964 | Matsch et al. | |
| 3,370,740 | A * | 2/1968 | Anderson | F25D 23/063 220/592.27 |
| 4,056,211 | A | 11/1977 | Zumwalt | |
| 4,646,934 | A | 3/1987 | McAllister | |
| 4,822,117 | A | 4/1989 | Boston, Jr. | |
| 4,959,111 | A | 9/1990 | Kruck et al. | |
| 5,011,729 | A | 4/1991 | McAllister | |
| 5,018,328 | A | 5/1991 | Cur | |
| 5,185,981 | A | 2/1993 | Martinez | |
| 5,512,345 | A | 4/1996 | Tsutsumi et al. | |
| 5,532,034 | A | 7/1996 | Kirby et al. | |
| 5,947,479 | A | 9/1999 | Ostrowski | |
| 6,038,830 | A | 3/2000 | Hirath et al. | |
| 6,244,458 | B1 | 6/2001 | Frysinger et al. | |
| 6,338,536 | B1 | 1/2002 | Ueno et al. | |
| 6,485,122 | B2 | 11/2002 | Wolf | |
| 8,857,931 | B2 | 10/2014 | Jung et al. | |
| 8,943,770 | B2 | 2/2015 | Sanders | |
| 8,944,541 | B2 * | 2/2015 | Allard | F25D 23/062 312/406 |
| 2002/0041134 | A1 | 4/2002 | Wolf et al. | |
| 2002/0100250 | A1 | 8/2002 | Hirath et al. | |
| 2002/0170265 | A1 | 11/2002 | Tokonabe et al. | |
| 2003/0115838 | A1 | 6/2003 | Rouanet et al. | |
| 2004/0051427 | A1 | 3/2004 | Cittadini et al. | |
| 2004/0226956 | A1 | 11/2004 | Brooks | |
| 2005/0235682 | A1 | 10/2005 | Hirai et al. | |
| 2007/0152551 | A1 * | 7/2007 | Kim | A47F 3/0482 312/401 |
| 2007/0243358 | A1 | 10/2007 | Gandini | |
| 2008/0110128 | A1 | 5/2008 | Hirath | |
| 2008/0289898 | A1 | 11/2008 | Rickards | |
| 2009/0113899 | A1 * | 5/2009 | Dain | F25D 11/04 62/48.1 |
| 2010/0104923 | A1 | 4/2010 | Takeguchi et al. | |
| 2011/0089802 | A1 | 4/2011 | Cording | |
| 2012/0104923 | A1 * | 5/2012 | Jung | F25D 23/066 312/406 |
| 2012/0125039 | A1 | 5/2012 | Hwang | |
| 2012/0128920 | A1 | 5/2012 | Yoon et al. | |
| 2013/0099650 | A1 | 4/2013 | Lee et al. | |
| 2013/0105494 | A1 | 5/2013 | Jung | |
| 2013/0105496 | A1 | 5/2013 | Jung | |
| 2013/0257257 | A1 | 10/2013 | Cur | |
| 2013/0293080 | A1 | 11/2013 | Kim | |
| 2014/0346942 | A1 | 11/2014 | Kim et al. | |
| 2015/0030800 | A1 | 1/2015 | Jung et al. | |
| 2015/0192356 | A1 | 7/2015 | Kang et al. | |
| 2018/0266620 | A1 | 9/2018 | Kawarazaki et al. | |
| 2018/0299060 | A1 | 10/2018 | Song et al. | |
| 2018/0313492 | A1 | 11/2018 | Kitano et al. | |

FOREIGN PATENT DOCUMENTS

| | | |
|---|---|---|
| CN | 1286386 | 3/2001 |
| CN | 1515857 | 7/2004 |
| CN | 2700790 | 5/2005 |
| CN | 1820173 | 8/2006 |
| CN | 1896657 | 1/2007 |
| CN | 101072968 | 11/2007 |
| CN | 101171472 | 4/2008 |
| CN | 201764779 | 3/2011 |
| CN | 201811526 | 4/2011 |
| CN | 102261470 | 11/2011 |
| CN | 102455103 | 5/2012 |
| CN | 102455105 | 5/2012 |
| CN | 102818421 | 12/2012 |
| CN | 102927740 | 2/2013 |
| CN | 103090616 | 5/2013 |
| CN | 103189696 | 7/2013 |
| CN | 203095854 | 7/2013 |
| CN | 103542660 | 1/2014 |
| CN | 103575038 | 2/2014 |
| CN | 103649658 | 3/2014 |
| CN | 104180595 | 12/2014 |
| CN | 104204646 | 12/2014 |
| CN | 104254749 | 12/2014 |
| CN | 104344653 | 2/2015 |
| CN | 104482707 | 4/2015 |
| CN | 104567215 | 4/2015 |
| CN | 104634047 | 5/2015 |
| CN | 104746690 | 7/2015 |
| DE | 956 899 | 1/1957 |
| DE | 28 02 910 | 8/1978 |
| DE | 31 21 351 | 12/1982 |
| DE | 9204365 | 7/1992 |
| DE | 197 45 825 | 4/1999 |
| DE | 299 12 917 | 11/1999 |
| DE | 199 07 182 | 8/2000 |
| DE | 10 2011 014 302 | 9/2012 |
| DE | 10 2011 079 209 | 1/2013 |
| EP | 0 658 733 | 6/1995 |
| EP | 0 892 120 | 1/1999 |
| EP | 1 477 752 | 11/2004 |
| EP | 1 484 563 | 12/2004 |
| EP | 1 614 954 | 1/2006 |
| EP | 2 333 179 | 6/2011 |
| EP | 2 447 639 | 5/2012 |
| EP | 2 806 239 | 11/2014 |
| EP | 2 829 827 | 1/2015 |
| EP | 2 952 839 | 12/2015 |
| GB | 890372 | 2/1962 |
| GB | 2 446 053 | 7/2008 |
| JP | 11-211334 | 8/1999 |
| JP | 2003-106760 | 4/2003 |
| JP | 2003-269688 | 9/2003 |
| JP | 2004-044980 | 2/2004 |
| JP | 2007-218509 | 8/2007 |
| JP | 2014-037931 | 2/2014 |
| KR | 10-0343719 | 7/2002 |
| KR | 10-2005-0065088 | 6/2005 |
| KR | 10-2010-0099629 | 9/2010 |
| KR | 10-2011-0015327 | 2/2011 |
| KR | 10-1041086 | 6/2011 |
| KR | 10-2015-0012712 | 2/2015 |
| KR | 10-1506413 | 3/2015 |
| NL | 1005962 | 11/1998 |
| RU | 129188 | 6/2013 |
| WO | WO 2006/003199 | 1/2006 |
| WO | WO 2012/084874 | 6/2012 |
| WO | WO 2014/175639 | 10/2014 |

OTHER PUBLICATIONS

European Search Report dated Feb. 13, 2019 issued in EP Application No. 16833311.0.
European Search Report dated Feb. 20, 2019 issued in EP Application No. 16833313.6.
European Search Report dated Feb. 22, 2019 issued in EP Application No. 16833312.8.
European Search Report dated Feb. 26, 2019 issued in EP Application No. 16833324.3.
European Search Report dated Feb. 26, 2019 issued in EP Application No. 16833336.7.
European Search Report dated Mar. 1, 2019 issued in EP Application No. 16833323.5.

(56) References Cited

OTHER PUBLICATIONS

European Search Report dated Mar. 1, 2019 issued in EP Application No. 16833338.3.
European Search Report dated Mar. 13, 2019 issued in EP Application No. 16833331.8.
European Search Report dated Mar. 15, 2019 issued in EP Application No. 16833326.8.
European Search Report dated Apr. 3, 2019 issued in EP Application No. 16833325.0.
International Search Report and Written Opinion dated Oct. 12, 2016 issued in Application No. PCT/KR2016/008465.
International Search Report and Written Opinion dated Oct. 12, 2016 issued in Application No. PCT/KR2016/008507.
International Search Report and Written Opinion dated Nov. 21, 2016 issued in Application No. PCT/KR2016/008466.
International Search Report and Written Opinion dated Nov. 21, 2016 issued in Application No. PCT/KR2016/008468.
International Search Report and Written Opinion dated Nov. 21, 2016 issued in Application No. PCT/KR2016/008469.
International Search Report and Written Opinion dated Nov. 21, 2016 issued in Application No. PCT/KR2016/008470.
International Search Report and Written Opinion dated Nov. 21, 2016 issued in Application No. PCT/KR2016/008501.
International Search Report and Written Opinion dated Nov. 21, 2016 issued in Application No. PCT/KR2016/008502.
International Search Report and Written Opinion dated Nov. 21, 2016 issued in Application No. PCT/KR2016/008505.
International Search Report and Written Opinion dated Nov. 21, 2016 issued in Application No. PCT/KR2016/008519.
International Search Report and Written Opinion dated Nov. 21, 2016 issued in Application No. PCT/KR2016/008523.
International Search Report and Written Opinion dated Dec. 7, 2016 issued in Application No. PCT/KR2016/008516.
International Search Report and Written Opinion dated Dec. 23, 2016 issued in Application No. PCT/KR2016/008512.
International Search Report and Written Opinion dated Dec. 23, 2016 issued in Application No. PCT/KR2016/008514.
European Search Report dated Dec. 21, 2018 issued in EP Application No. 16833330.0.
Russian Office Action dated Sep. 25, 2018 issued in RU Application No. 2018107646.
Chinese Office Action (with English translation) dated Jul. 15, 2019 issued in CN Application No. 201680045949.0.
Chinese Office Action (with English translation) dated Aug. 5, 2019 issued in CN Application No. 201680045869.5.
Chinese Office Action (with English translation) dated Aug. 5, 2019 issued in CN Application No. 201680045899.6.
Chinese Office Action (with English translation) dated Aug. 5, 2019 issued in CN Application No. 201680045908.1.
Chinese Office Action (with English translation) dated Aug. 5, 2019 issued in CN Application No. 201680045935.9.
Chinese Office Action (with English translation) dated Aug. 5, 2019 issued in CN Application No. 201680046042.6.
Chinese Office Action (with English translation) dated Aug. 5, 2019 issued in CN Application No. 201680046048.3.
Chinese Office Action (with English translation) dated Aug. 13, 2019 issued in CN Application No. 201680045950.3.
Chinese Office Action (with English translation) dated Sep. 19, 2019 issued in CN Application No. 201680045897. 7.
Chinese Office Action (with English translation) dated Sep. 19, 2019 issued in CN Application No. 201680045898.1.
Chinese Office Action (with English translation) dated Sep. 19, 2019 issued in CN Application No. 201680046047.9.
United States Office Action dated Sep. 20, 2019 issued in U.S. Appl. No. 15/749,149.
U.S. Office Action dated Oct. 4, 2019 issued in related U.S. Appl. No. 15/749,140.
U.S. Office Action dated Oct. 17, 2019 issued in U.S. Appl. No. 15/749,147.
U.S. Office Action dated Oct. 17, 2019 issued in U.S. Appl. No. 15/749,143.
U.S. Office Action dated Oct. 17, 2019 issued in U.S. Appl. No. 15/749,162.
United States Office Action dated Dec. 10, 2019 issued in U.S. Appl. No. 15/749,132.
U.S. Office Action dated Jun. 13, 2019 issued in related U.S. Appl. No. 15/749,139.
U.S. Office Action dated Jun. 13, 2019 issued in related U.S. Appl. No. 15/749,136.

* cited by examiner

[Fig. 1]
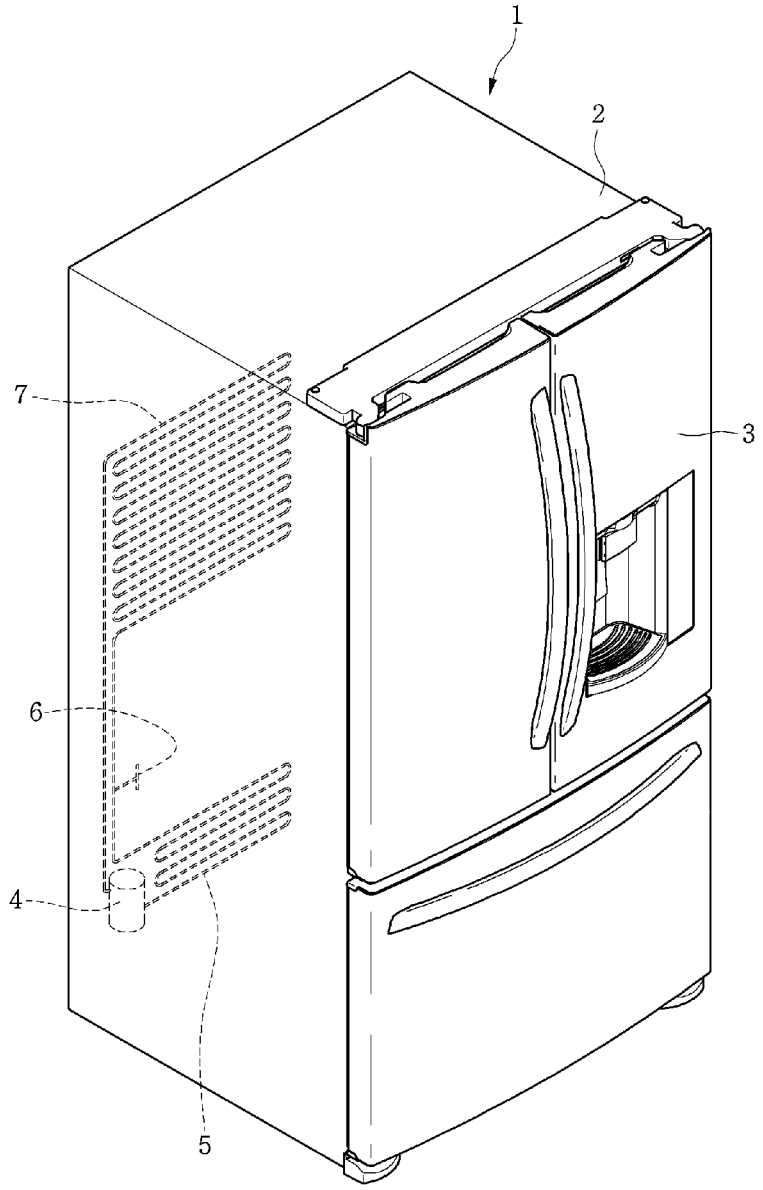

[Fig. 2]
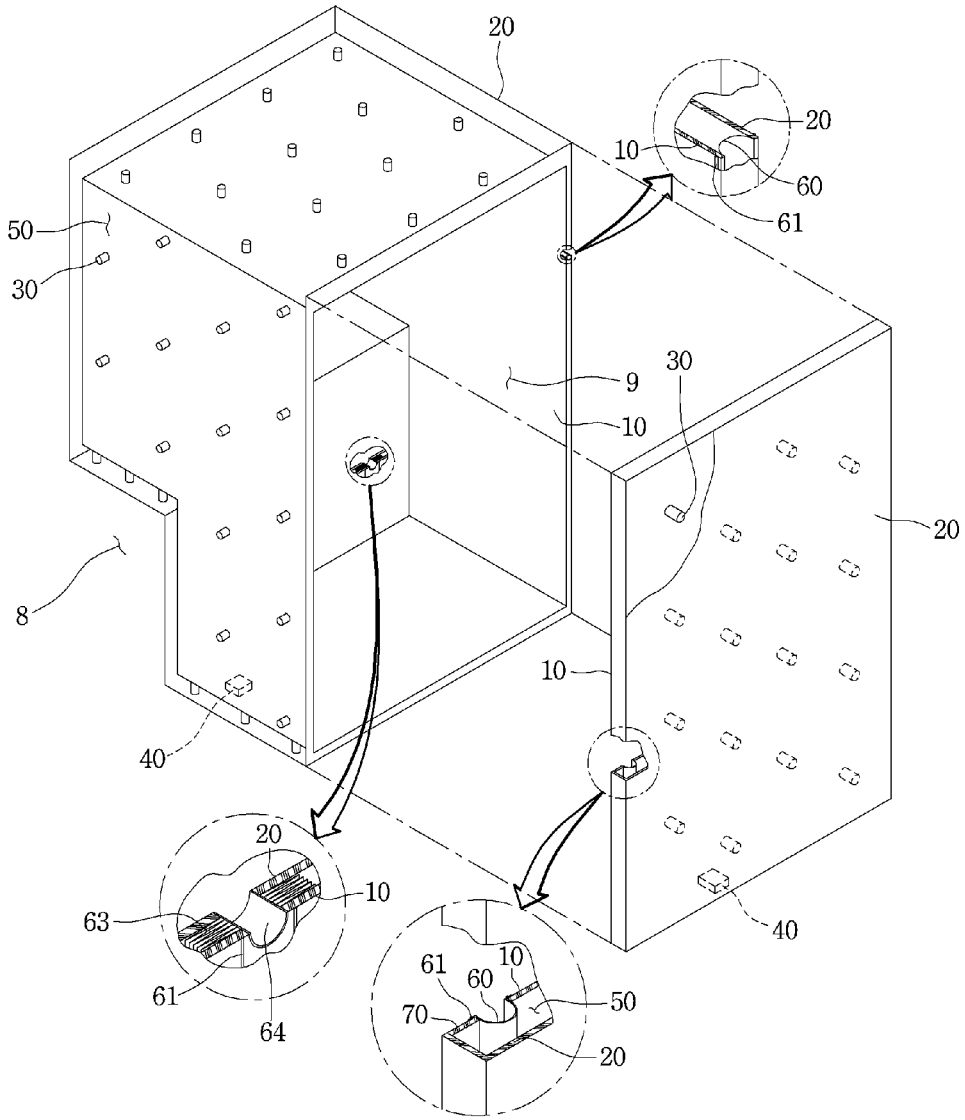

[Fig. 3]
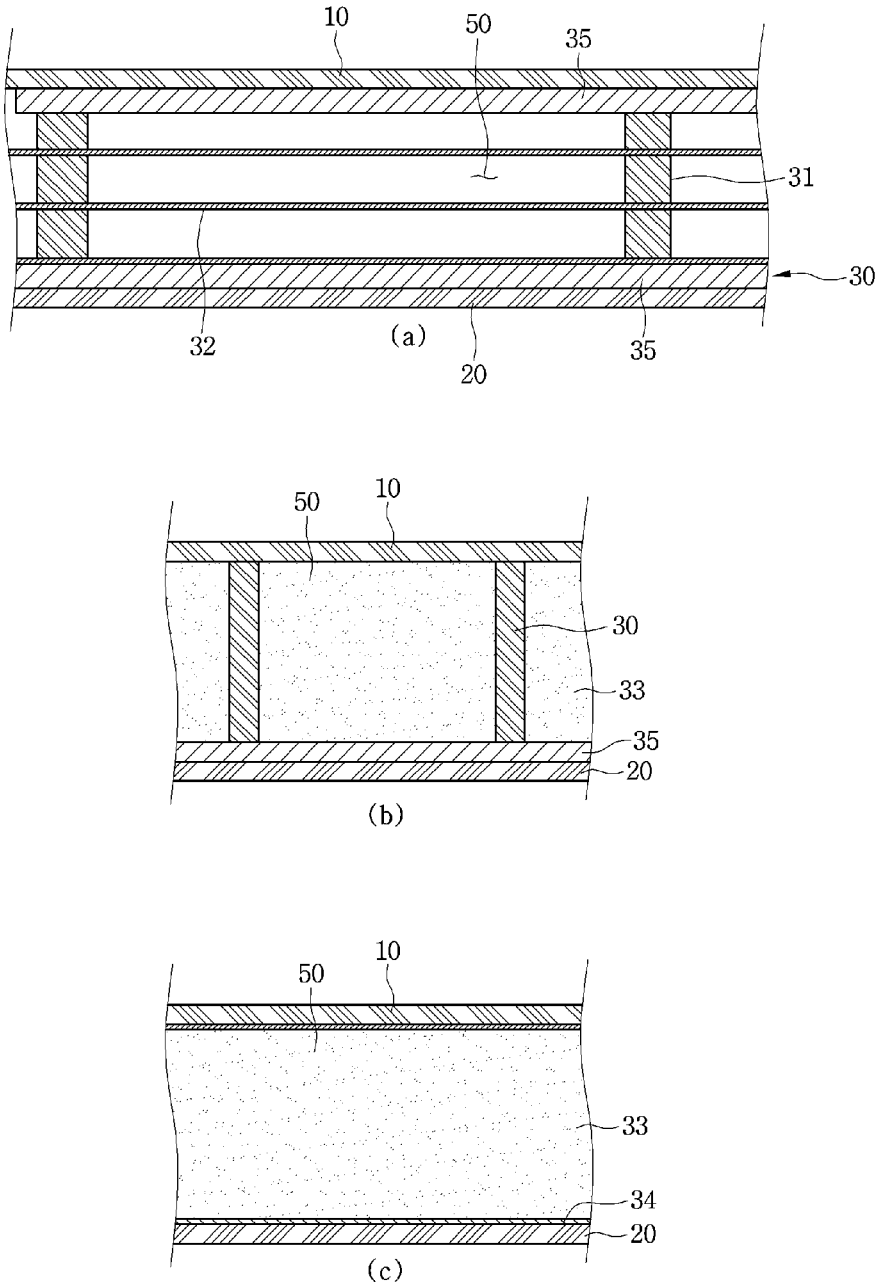

[Fig. 4]
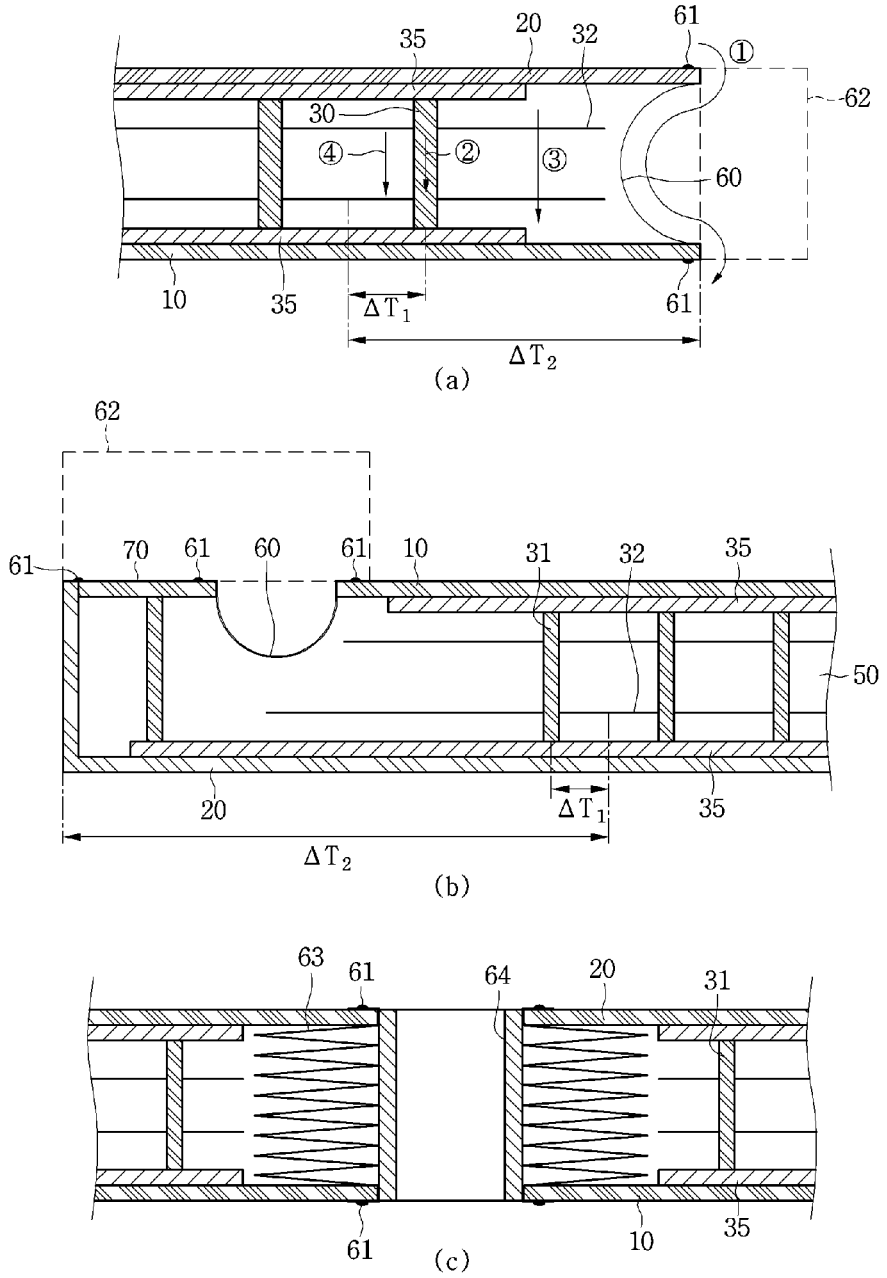

[Fig. 5]
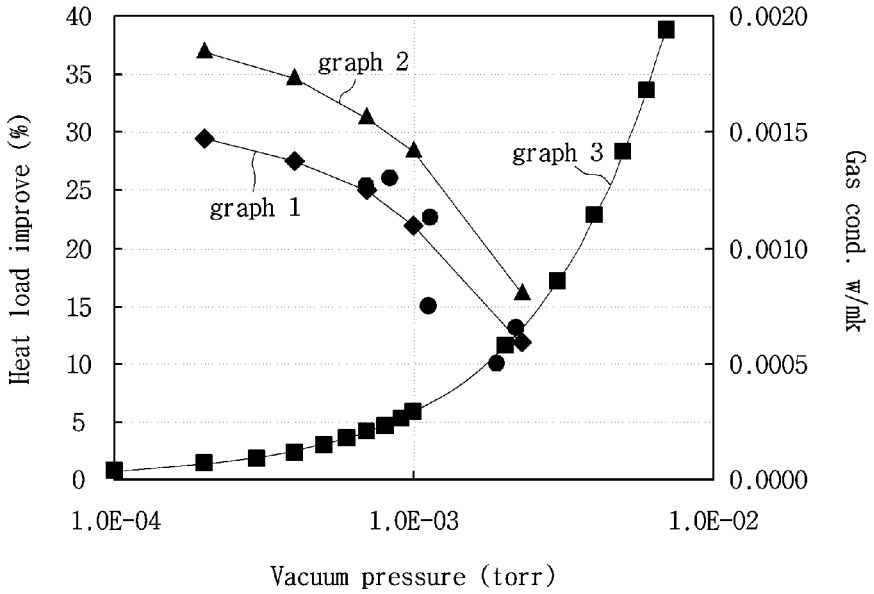
[Fig. 6]
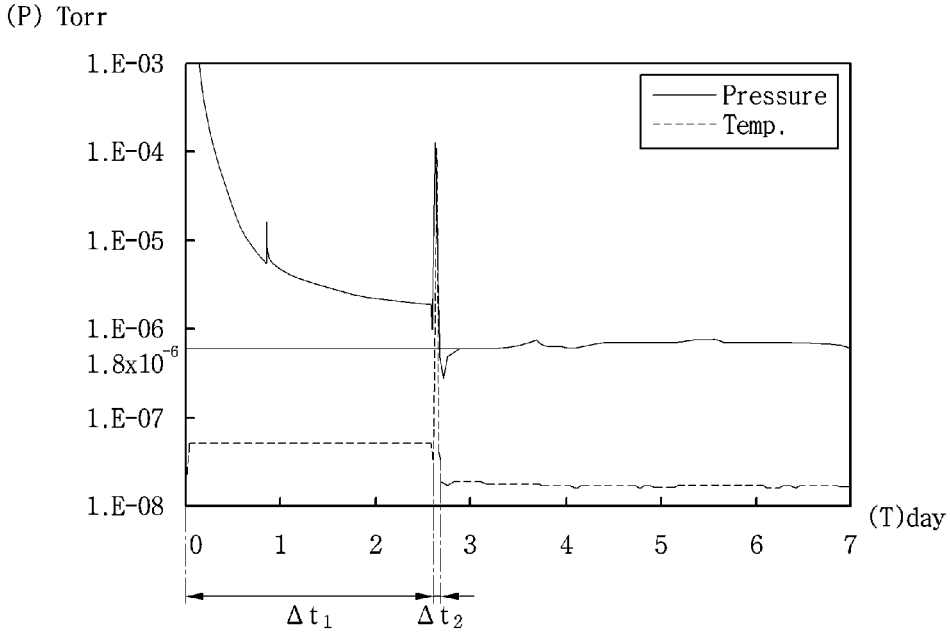

[Fig. 7]
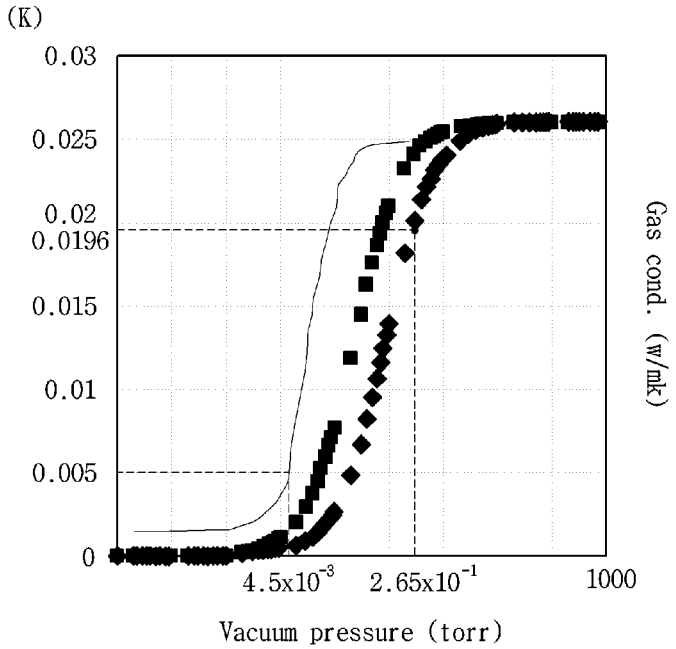
[Fig. 8]
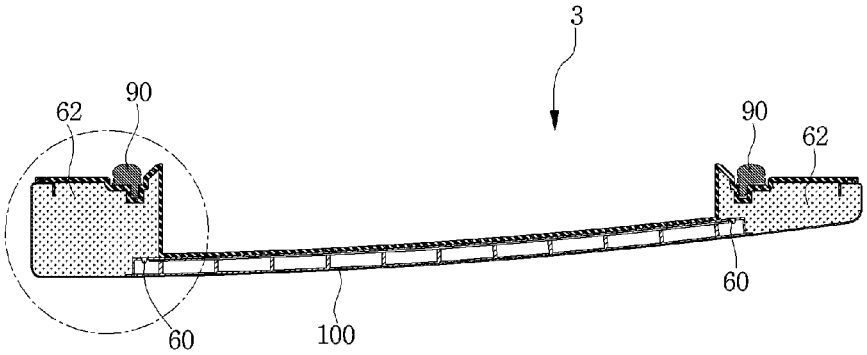

[Fig. 9]
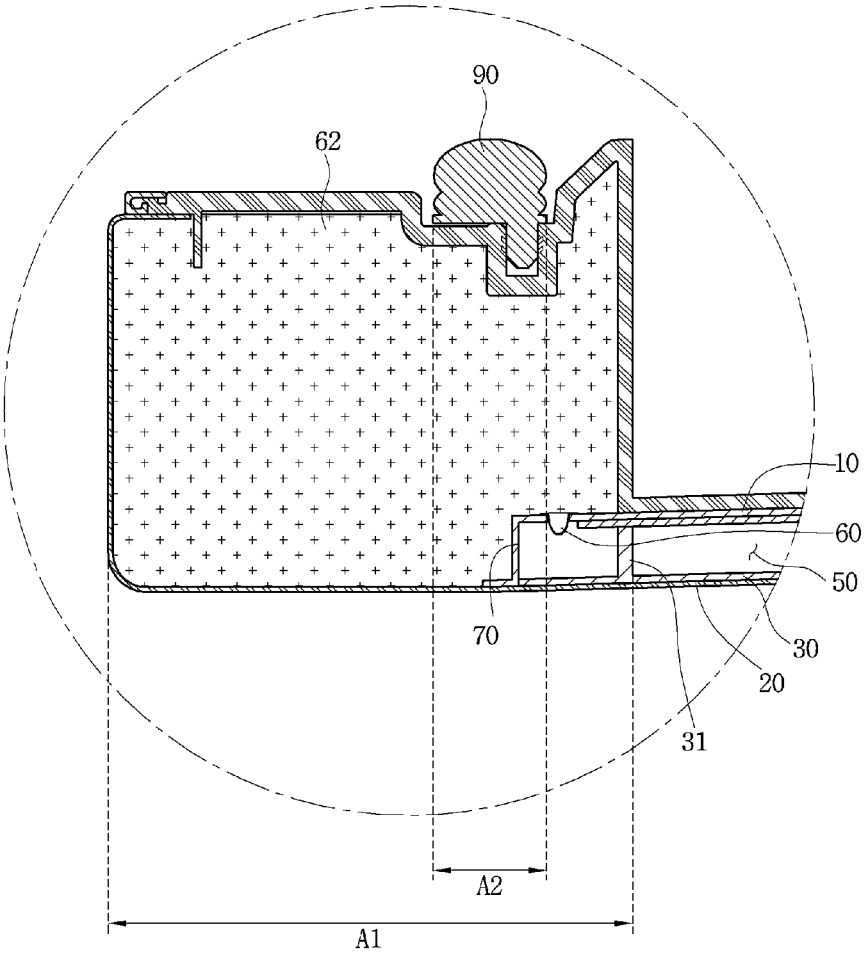
[Fig. 10]
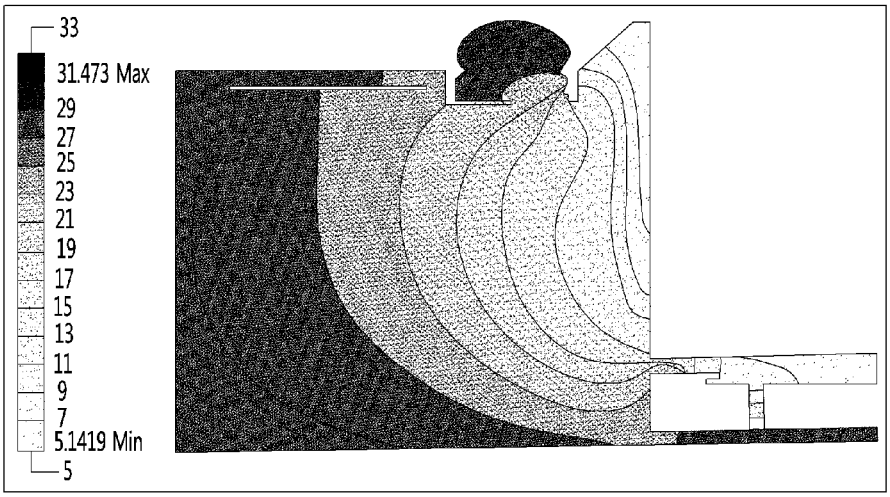

[Fig. 11]
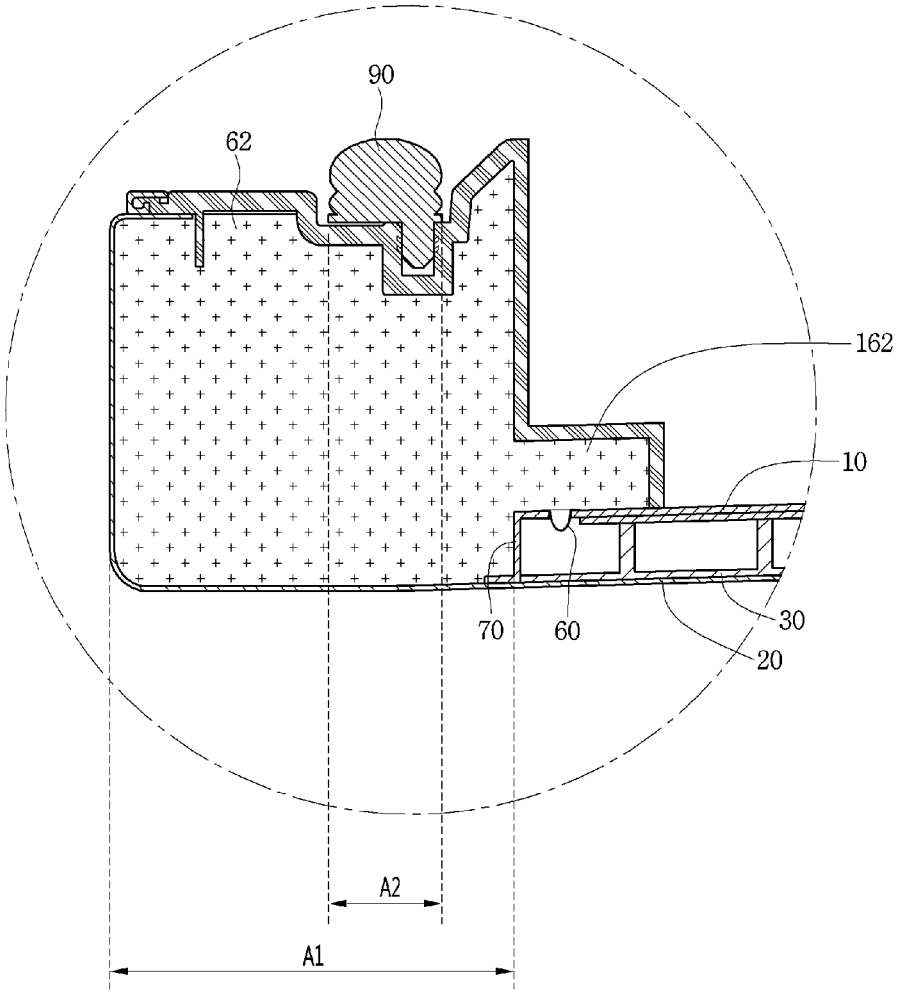
[Fig. 12]
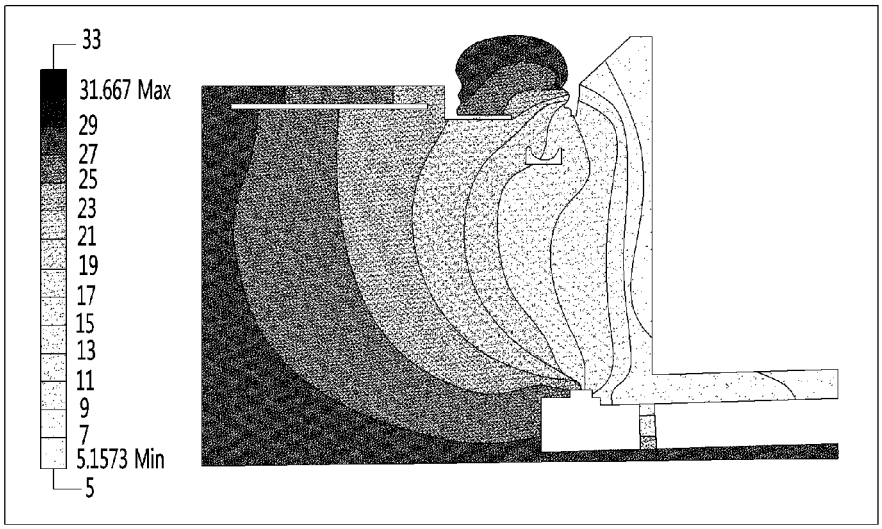

[Fig. 13]
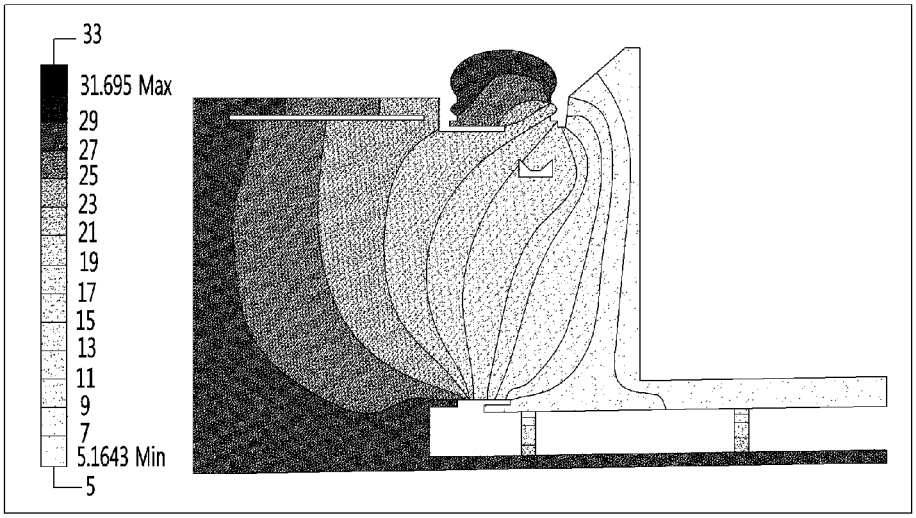
[Fig. 14]
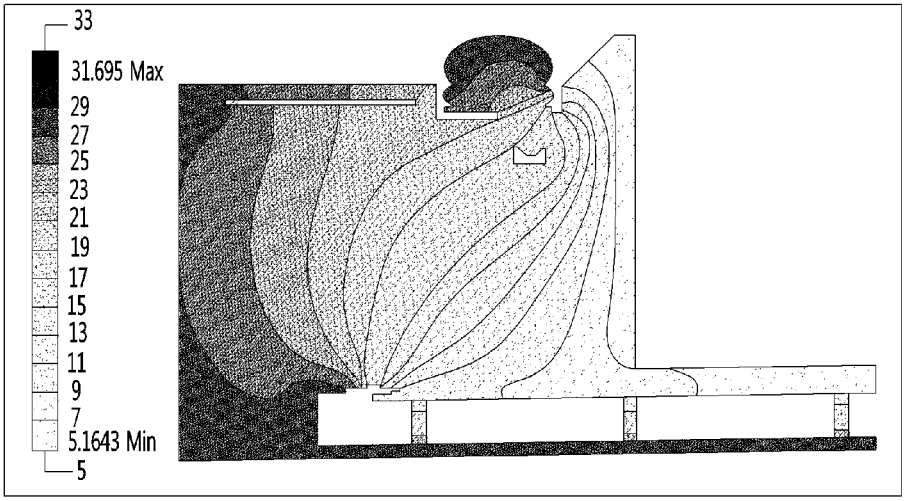

[Fig. 15]
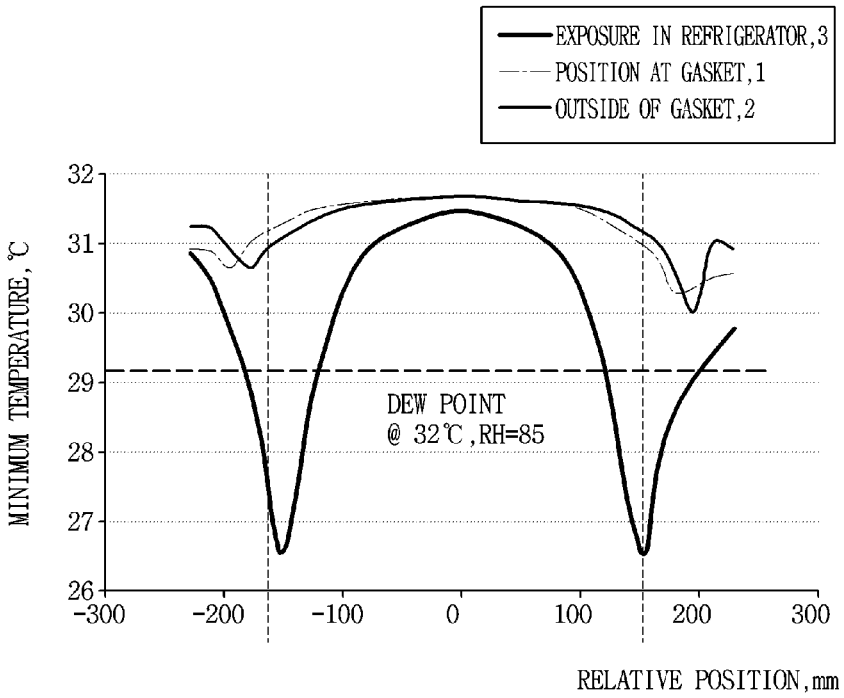
[Fig. 16]
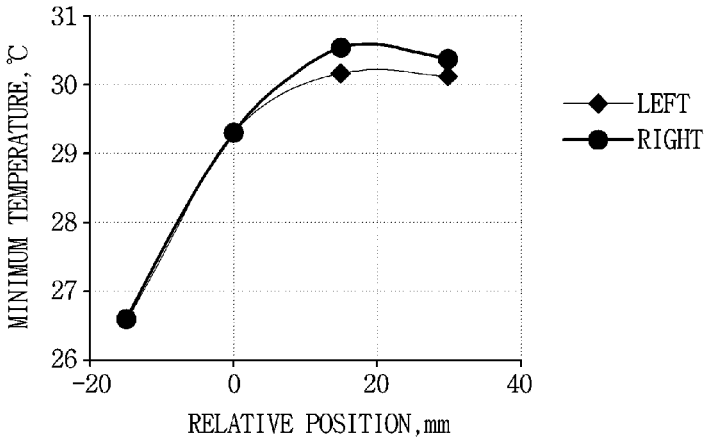
[Fig. 17]
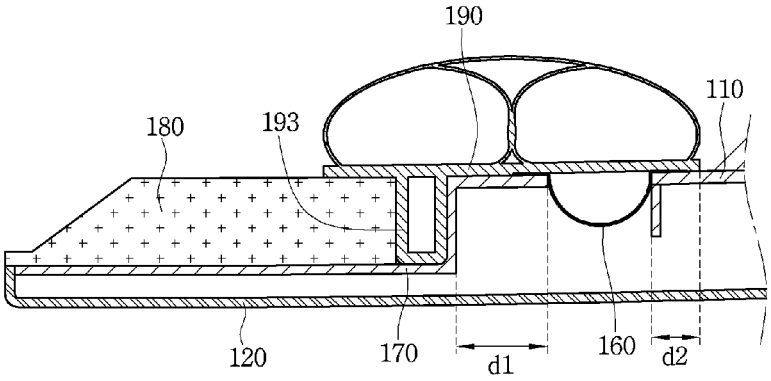

VACUUM ADIABATIC BODY AND REFRIGERATOR

CROSS REFERENCE TO RELATED PATENT APPLICATIONS

This application is a U.S. National Stage Application under 35 U.S.C. § 371 of PCT Application No. PCT/KR2016/008514, filed Aug. 2, 2017, which claims priority to Korean Patent Application No. 10-2015-0109623, filed Aug. 3, 2015, whose entire disclosures are hereby incorporated by reference.

U.S. application Ser. Nos. 15/749,132; 15/749,139; 15/749,136; 15/749,143; 15/749,146; 15/749,156; 15/749,162; 17/749,140; 15/749,142; 15/749,179; 15/749,149; 15/749,179; 15/749,154; 15/749,161, all filed on Jan. 31, 2018, are related and are hereby incorporated by reference in their entirety. Further, one of ordinary skill in the art will recognize that features disclosed in these above-noted applications may be combined in any combination with features disclosed herein.

TECHNICAL FIELD

The present disclosure relates to a vacuum adiabatic body and a refrigerator.

BACKGROUND ART

A vacuum adiabatic body is a product for suppressing heat transfer by vacuumizing the interior of a body thereof. The vacuum adiabatic body can reduce heat transfer by convection and conduction, and hence is applied to heating apparatuses and refrigerating apparatuses. In a typical adiabatic method applied to a refrigerator, although it is differently applied in refrigeration and freezing, a foam urethane adiabatic wall having a thickness of about 30 cm or more is generally provided. However, the internal volume of the refrigerator is therefore reduced. In order to increase the internal volume of a refrigerator, there is an attempt to apply a vacuum adiabatic body to the refrigerator.

First, Korean Patent No. 10-0343719 (Reference Document 1) of the present applicant has been disclosed. According to Reference Document 1, there is disclosed a method in which a vacuum adiabatic panel is prepared and then built in walls of a refrigerator, and the exterior of the vacuum adiabatic panel is finished with a separate molding such as Styrofoam (polystyrene). According to the method, additional foaming is not required, and the adiabatic performance of the refrigerator is improved. However, manufacturing cost is increased, and a manufacturing method is complicated.

As another example, a technique of providing walls using a vacuum adiabatic material and additionally providing adiabatic walls using a foam filling material has been disclosed in Korean Patent Publication No. 10-2015-0012712 (Reference Document 2). According to Reference Document 2, manufacturing cost is increased, and a manufacturing method is complicated.

As another example, there is an attempt to manufacture all walls of a refrigerator using a vacuum adiabatic body that is a single product. For example, a technique of providing an adiabatic structure of a refrigerator to be in a vacuum state has been disclosed in U.S. Patent Laid-Open Publication No. US 2004/0226956 A1 (Reference Document 3).

However, it is difficult to obtain an adiabatic effect of a practical level by providing the walls of the refrigerator to be in a sufficient vacuum state. Specifically, it is difficult to prevent heat transfer at a contact portion between external and internal cases having different temperatures. Further, it is difficult to maintain a stable vacuum state. Furthermore, it is difficult to prevent deformation of the cases due to a sound pressure in the vacuum state. Due to these problems, the technique of Reference Document 3 is limited to cryogenic refrigerating apparatuses, and is not applied to refrigerating apparatuses used in general households.

DISCLOSURE

Technical Problem

Embodiments provide a vacuum adiabatic body and a refrigerator, which can obtain a sufficient adiabatic effect in a vacuum state and be applied commercially. Embodiments also provide a vacuum adiabatic body in which the position of a conductive resistance sheet provided in the vacuum adiabatic body is optimized, thereby improving adiabatic performance.

Technical Solution

In one embodiment, a vacuum adiabatic body includes: a first plate member defining at least one portion of a wall for a first space; a second plate member defining at least one portion of a wall for a second space having a different temperature from the first space; a sealing part sealing the first plate member and the second plate member to provide a third space that has a temperature between the temperature of the first space and the temperature of the second space and is in a vacuum state; a supporting unit maintaining the third space; a heat resistance unit for decreasing a heat transfer amount between the first plate member and the second plate member; and an exhaust port through which a gas in the third space is exhausted, wherein the heat resistance unit includes a conductive resistance sheet connected to the first plate member, the conductive resistance sheet resisting heat conduction flowing along a wall for the third space, the conductive resistance sheet includes a shielding part for heat-insulating the conductive resistance sheet by shielding one surface of the conductive resistance sheet, and the other surface of the conductive resistance sheet is heat-insulated by the third space.

In another embodiment, a vacuum adiabatic body includes: a first plate member defining at least one portion of a wall for a first space; a second plate member defining at least one portion of a wall for a second space having a different temperature from the first space; a sealing part sealing the first plate member and the second plate member to provide a third space that has a temperature between the temperature of the first space and the temperature of the second space and is in a vacuum state; a supporting unit maintaining the third space; a heat resistance unit for decreasing a heat transfer amount between the first plate member and the second plate member; and an exhaust port through which a gas in the third space is exhausted, wherein the heat resistance unit includes a conductive resistance sheet connected to the first plate member, the conductive resistance sheet resisting heat conduction flowing along a wall for the third space, a thickness of the conductive resistance sheet is thinner than the first and second plate members, and a shielding part for heat-insulating the conductive resistance sheet is provided at an outside of the conductive resistance sheet.

In still another embodiment, a refrigerator includes: a main body provided with an internal space in which storage goods are stored; and a door provided to open/close the main body from an external space, wherein, in order to supply a refrigerant into the main body, the refrigerator includes: a compressor for compressing the refrigerant; a condenser for condensing the compressed refrigerant; an expander for expanding the condensed refrigerant; and an evaporator for evaporating the expanded refrigerant to take heat, wherein at least one of the main body and the door includes a vacuum adiabatic body, wherein the vacuum adiabatic body includes: a first plate member defining at least one portion of a wall for the internal space; a second plate member defining at least one portion of a wall for the external space; a sealing part sealing the first plate member and the second plate member to provide a vacuum space part that has a temperature between a temperature of the internal space and a temperature of the external space and is in a vacuum state; a supporting unit maintaining the vacuum space part; a heat resistance unit for decreasing a heat transfer amount between the first plate member and the second plate member; and an exhaust port through which a gas in the vacuum space part is exhausted, wherein a shielding part for heat-insulating the conductive resistance sheet is provided at an outside of the conductive resistance sheet.

Advantageous Effects

According to the present disclosure, it is possible to provide a vacuum adiabatic body having a vacuum adiabatic effect and a refrigerator including the same.

DESCRIPTION OF DRAWINGS

FIG. 1 is a perspective view of a refrigerator according to an embodiment.

FIG. 2 is a view schematically showing a vacuum adiabatic body used in a main body and a door of the refrigerator.

FIG. 3 is a view showing various embodiments of an internal configuration of a vacuum space part.

FIG. 4 is a view showing various embodiments of conductive resistance sheets and peripheral parts thereof.

FIG. 5 illustrates graphs showing changes in adiabatic performance and changes in gas conductivity with respect to vacuum pressures by applying a simulation.

FIG. 6 illustrates graphs obtained by observing, over time and pressure, a process of exhausting the interior of the vacuum adiabatic body when a supporting unit is used.

FIG. 7 illustrates graphs obtained by comparing vacuum pressures and gas conductivities.

FIG. 8 is a section view of the door of FIG. 1.

FIG. 9 is an enlarged view of FIG. 8.

FIG. 10 is a view showing a result obtained by analyzing heat transfer when the conductive resistance sheet is disposed at an outside of a shielding part.

FIG. 11 is a sectional view of a door according to another embodiment.

FIGS. 12 to 14 are views showing results obtained by analyzing heat transfer with respect to positions of the conductive resistance sheet.

FIGS. 15 and 16 are graphs showing minimum temperatures of an outer surface of a second plate member with respect to relative positions of the conductive resistance sheet.

FIG. 17 is a sectional view of a door according to still another embodiment.

MODE FOR INVENTION

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the disclosure may be practiced. These embodiments are described in sufficient detail to enable those skilled in the art to practice the disclosure, and it is understood that other embodiments may be utilized and that logical structural, mechanical, electrical, and chemical changes may be made without departing from the spirit or scope of the disclosure. To avoid detail not necessary to enable those skilled in the art to practice the disclosure, the description may omit certain information known to those skilled in the art. The following detailed description is, therefore, not to be taken in a limiting sense.

In the following description, the term 'vacuum pressure' means a certain pressure state lower than atmospheric pressure. In addition, the expression that a vacuum degree of A is higher than that of B means that a vacuum pressure of A is lower than that of B.

FIG. 1 is a perspective view of a refrigerator according to an embodiment. FIG. 2 is a view schematically showing a vacuum adiabatic body used in the main body and the door of the refrigerator. In FIG. 2, a main body-side vacuum adiabatic body is illustrated in a state in which top and side walls are removed, and a door-side vacuum adiabatic body is illustrated in a state in which a portion of a front wall is removed. In addition, sections of portions at conductive resistance sheets are provided are schematically illustrated for convenience of understanding.

Referring to FIGS. 1 and 2, the refrigerator 1 includes a main body 2 provided with a cavity 9 capable of storing storage goods and a door 3 provided to open/close the main body 2. The door 3 may be rotatably or movably disposed to open/close the cavity 9. The cavity 9 may provide at least one of a refrigerating chamber and a freezing chamber.

Parts constituting a freezing cycle in which cold air is supplied into the cavity 9 may be included. Specifically, the parts include a compressor 4 for compressing a refrigerant, a condenser 5 for condensing the compressed refrigerant, an expander 6 for expanding the condensed refrigerant, and an evaporator 7 for evaporating the expanded refrigerant to take heat. As a typical structure, a fan may be installed at a position adjacent to the evaporator 7, and a fluid blown from the fan may pass through the evaporator 7 and then be blown into the cavity 9. A freezing load is controlled by adjusting the blowing amount and blowing direction by the fan, adjusting the amount of a circulated refrigerant, or adjusting the compression rate of the compressor, so that it is possible to control a refrigerating space or a freezing space.

The vacuum adiabatic body includes a first plate member (or first plate 10 for providing a wall of a low-temperature space, a second plate member (or second plate) 20 for providing a wall of a high-temperature space, and a vacuum space part (or vacuum space) 50 defined as a gap part between the first and second plate members 10 and 20. Also, the vacuum adiabatic body includes the conductive resistance sheets 60 and 62 for preventing heat conduction between the first and second plate members 10 and 20.

A sealing part (or seal) 61 for sealing the first and second plate members 10 and 20 is provided such that the vacuum space part 50 is in a sealing state. When the vacuum adiabatic body is applied to a refrigerating or heating cabinet, the first plate member 10 may be referred to as an inner case, and the second plate member 20 may be referred to as an outer case. A machine chamber 8 in which parts providing a freezing cycle are accommodated is placed at a lower rear side of the main body-side vacuum adiabatic body, and an exhaust port 40 for forming a vacuum state by exhausting air in the vacuum space part 50 is provided at any one side of the vacuum adiabatic body. In addition, a pipeline 64 passing through the vacuum space part 50 may be further installed so as to install a defrosting water line and electric lines.

The first plate member 10 may define at least one portion of a wall for a first space provided thereto. The second plate member 20 may define at least one portion of a wall for a second space provided thereto. The first space and the second space may be defined as spaces having different temperatures. Here, the wall for each space may serve as not only a wall directly contacting the space but also a wall not contacting the space. For example, the vacuum adiabatic body of the embodiment may also be applied to a product further having a separate wall contacting each space.

Factors of heat transfer, which cause loss of the adiabatic effect of the vacuum adiabatic body, are heat conduction between the first and second plate members 10 and 20, heat radiation between the first and second plate members 10 and 20, and gas conduction of the vacuum space part 50.

Hereinafter, a heat resistance unit provided to reduce adiabatic loss related to the factors of the heat transfer will be provided. Meanwhile, the vacuum adiabatic body and the refrigerator of the embodiment do not exclude that another adiabatic means is further provided to at least one side of the vacuum adiabatic body. Therefore, an adiabatic means using foaming or the like may be further provided to another side of the vacuum adiabatic body.

FIG. 3 is a view showing various embodiments of an internal configuration of the vacuum space part. First, referring to FIG. 3*a*, the vacuum space part 50 is provided in a third space having a different pressure from the first and second spaces, preferably, a vacuum state, thereby reducing adiabatic loss. The third space may be provided at a temperature between the temperature of the first space and the temperature of the second space. Since the third space is provided as a space in the vacuum state, the first and second plate members 10 and 20 receive a force contracting in a direction in which they approach each other due to a force corresponding to a pressure difference between the first and second spaces. Therefore, the vacuum space part 50 may be deformed in a direction in which it is reduced. In this case, adiabatic loss may be caused due to an increase in amount of heat radiation, caused by the contraction of the vacuum space part 50, and an increase in amount of heat conduction, caused by contact between the plate members 10 and 20.

A supporting unit (or support) 30 may be provided to reduce the deformation of the vacuum space part 50. The supporting unit 30 includes bars 31. The bars 31 may extend in a direction substantially vertical to the first and second plate members 10 and 20 so as to support a distance between the first and second plate members 10 and 20. A support plate 35 may be additionally provided to at least one end of the bar 31. The support plate 35 connects at least two bars 31 to each other, and may extend in a direction horizontal to the first and second plate members 10 and 20.

The support plate 35 may be provided in a plate shape, or may be provided in a lattice shape such that its area contacting the first or second plate member 10 or 20 is decreased, thereby reducing heat transfer. The bars 31 and the support plate 35 are fixed to each other at at least one portion, to be inserted together between the first and second plate members 10 and 20. The support plate 35 contacts at least one of the first and second plate members 10 and 20, thereby preventing deformation of the first and second plate members 10 and 20.

In addition, based on the extending direction of the bars 31, a total sectional area of the support plate 35 is provided to be greater than that of the bars 31, so that heat transferred through the bars 31 can be diffused through the support plate 35. A material of the supporting unit 30 may include a resin selected from the group consisting of PC, glass fiber PC, low outgassing PC, PPS, and LCP so as to obtain high compressive strength, low outgassing and water absorptance, low thermal conductivity, high compressive strength at high temperature, and excellent machinability.

A radiation resistance sheet 32 for reducing heat radiation between the first and second plate members 10 and 20 through the vacuum space part 50 will be described. The first and second plate members 10 and 20 may be made of a stainless material capable of preventing corrosion and providing a sufficient strength. The stainless material has a relatively high emissivity of 0.16, and hence a large amount of radiation heat may be transferred.

In addition, the supporting unit 30 made of the resin has a lower emissivity than the plate members, and is not entirely provided to inner surfaces of the first and second plate members 10 and 20. Hence, the supporting unit 30 does not have great influence on radiation heat. Therefore, the radiation resistance sheet 32 may be provided in a plate shape over a majority of the area of the vacuum space part 50 so as to concentrate on reduction of radiation heat transferred between the first and second plate members 10 and 20.

A product having a low emissivity may be preferably used as the material of the radiation resistance sheet 32. In an embodiment, an aluminum foil having an emissivity of 0.02 may be used as the radiation resistance sheet 32. Since the transfer of radiation heat cannot be sufficiently blocked using one radiation resistance sheet, at least two radiation resistance sheets 32 may be provided at a certain distance so as not to contact each other. In addition, at least one radiation resistance sheet may be provided in a state in which it contacts the inner surface of the first or second plate member 10 or 20.

Referring to FIG. 3*b*, the distance between the plate members is maintained by the supporting unit 30, and a porous material 33 may be filled in the vacuum space part 50. The porous material 33 may have a higher emissivity than the stainless material of the first and second plate members 10 and 20. However, since the porous material 33 is filled in the vacuum space part 50, the porous material 33 has a high efficiency for blocking the transfer of radiation heat. In this embodiment, the vacuum adiabatic body can be manufactured without using the radiation resistance sheet 32.

Referring to FIG. 3*c*, the supporting unit 30 maintaining the vacuum space part 50 is not provided. Instead of the supporting unit 30, the porous material 33 is provided in a state in which it is surrounded by a film 34. In this case, the porous material 33 may be provided in a state in which it is compressed so as to maintain the gap of the vacuum space part 50. The film 34 is made of, for example, a PE material, and may be provided in a state in which holes are formed therein.

In this embodiment, the vacuum adiabatic body can be manufactured without using the supporting unit 30. In other words, the porous material 33 can serve together as the radiation resistance sheet 32 and the supporting unit 30.

FIG. 4 is a view showing various embodiments of the conductive resistance sheets and peripheral parts thereof. Structures of the conductive resistance sheets are briefly illustrated in FIG. 2, but will be understood in detail with reference to FIG. 4.

First, a conductive resistance sheet proposed in FIG. 4*a* may be preferably applied to the main body-side vacuum adiabatic body. Specifically, the first and second plate members 10 and 20 are to be sealed so as to vacuumize the interior of the vacuum adiabatic body. In this case, since the two plate members have different temperatures from each other, heat transfer may occur between the two plate members. A conductive resistance sheet 60 is provided to prevent heat conduction between two different kinds of plate members.

The conductive resistance sheet 60 may be provided with sealing parts 61 at which both ends of the conductive resistance sheet 60 are sealed to define at least one portion of the wall for the third space and maintain the vacuum state. The conductive resistance sheet 60 may be provided as a thin foil in units of micrometers so as to reduce the amount of heat conducted along the wall for the third space. The sealing parts 61 may be provided as welding parts. That is, the conductive resistance sheet 60 and the plate members 10 and 20 may be fused to each other.

In order to cause a fusing action between the conductive resistance sheet 60 and the plate members 10 and 20, the conductive resistance sheet 60 and the plate members 10 and 20 may be made of the same material, and a stainless material may be used as the material. The sealing parts 61 are not limited to the welding parts, and may be provided through a process such as cocking. The conductive resistance sheet 60 may be provided in a curved shape. Thus, a heat conduction distance of the conductive resistance sheet 60 is provided longer than the linear distance of each plate member, so that the amount of heat conduction can be further reduced.

A change in temperature occurs along the conductive resistance sheet 60. Therefore, in order to block heat transfer to the exterior of the conductive resistance sheet 60, a shielding part (or shield) 62 may be provided at the exterior of the conductive resistance sheet 60 such that an adiabatic action occurs. In other words, in the refrigerator, the second plate member 20 has a high temperature and the first plate member 10 has a low temperature. In addition, heat conduction from high temperature to low temperature occurs in the conductive resistance sheet 60, and hence the temperature of the conductive resistance sheet 60 is suddenly changed. Therefore, when the conductive resistance sheet 60 is opened to the exterior thereof, heat transfer through the opened place may seriously occur.

In order to reduce heat loss, the shielding part 62 is provided at the exterior of the conductive resistance sheet 60. For example, when the conductive resistance sheet 60 is exposed to any one of the low-temperature space and the high-temperature space, the conductive resistance sheet 60 does not serve as a conductive resistor as well as the exposed portion thereof, which is not preferable.

The shielding part 62 may be provided as a porous material contacting an outer surface of the conductive resistance sheet 60. The shielding part 62 may be provided as an adiabatic structure, e.g., a separate gasket, which is placed at the exterior of the conductive resistance sheet 60. The shielding part 62 may be provided as a portion of the vacuum adiabatic body, which is provided at a position facing a corresponding conductive resistance sheet 60 when the main body-side vacuum adiabatic body is closed with respect to the door-side vacuum adiabatic body. In order to reduce heat loss even when the main body and the door are opened, the shielding part 62 may be preferably provided as a porous material or a separate adiabatic structure.

A conductive resistance sheet proposed in FIG. 4*b* may be preferably applied to the door-side vacuum adiabatic body. In FIG. 4*b*, portions different from those of FIG. 4*a* are described in detail, and the same description is applied to portions identical to those of FIG. 4*a*. A side frame 70 is further provided at an outside of the conductive resistance sheet 60. A part for sealing between the door and the main body, an exhaust port necessary for an exhaust process, a getter port for vacuum maintenance, and the like may be placed on the side frame 70. This is because the mounting of parts is convenient in the main body-side vacuum adiabatic body, but the mounting positions of parts are limited in the door-side vacuum adiabatic body.

In the door-side vacuum adiabatic body, it is difficult to place the conductive resistance sheet 60 at a front end portion of the vacuum space part, i.e., a corner side portion of the vacuum space part. This is because, unlike the main body, a corner edge portion of the door is exposed to the exterior. More specifically, if the conductive resistance sheet 60 is placed at the front end portion of the vacuum space part, the corner edge portion of the door is exposed to the exterior, and hence there is a disadvantage in that a separate adiabatic part should be configured so as to improve the adiabatic performance of the conductive resistance sheet 60.

A conductive resistance sheet proposed in FIG. 4*c* may be preferably installed in the pipeline passing through the vacuum space part. In FIG. 4*c*, portions different from those of FIGS. 4*a* and 4*b* are described in detail, and the same description is applied to portions identical to those of FIGS. 4*a* and 4*b*. A conductive resistance sheet having the same shape as that of FIG. 4*a*, preferably, a wrinkled conductive resistance sheet 63 may be provided at a peripheral portion of the pipeline 64. Accordingly, a heat transfer path can be lengthened, and deformation caused by a pressure difference can be prevented. In addition, a separate shielding part may be provided to improve the adiabatic performance of the conductive resistance sheet.

A heat transfer path between the first and second plate members 10 and 20 will be described with reference back to FIG. 4*a*. Heat passing through the vacuum adiabatic body may be divided into surface conduction heat ① conducted along a surface of the vacuum adiabatic body, more specifically, the conductive resistance sheet 60, supporter conduction heat ② conducted along the supporting unit 30 provided inside the vacuum adiabatic body, gas conduction heat (or convection) ③ conducted through an internal gas in the vacuum space part, and radiation transfer heat ④ transferred through the vacuum space part.

The transfer heat may be changed depending on various design dimensions. For example, the supporting unit may be changed such that the first and second plate members 10 and 20 can endure a vacuum pressure without being deformed, the vacuum pressure may be changed, the distance between the plate members may be changed, and the length of the conductive resistance sheet may be changed. The transfer heat may be changed depending on a difference in temperature between the spaces (the first and second spaces) respectively provided by the plate members. In the embodiment, a preferred configuration of the vacuum adiabatic body has been found by considering that its total heat transfer amount is smaller than that of a typical adiabatic structure formed by foaming polyurethane. In a typical refrigerator including the adiabatic structure formed by foaming the polyurethane, an effective heat transfer coefficient may be proposed as 19.6 mW/mK.

By performing a relative analysis on heat transfer amounts of the vacuum adiabatic body of the embodiment, a heat transfer amount by the gas conduction heat ③ can become smallest. For example, the heat transfer amount by the gas conduction heat ③ may be controlled to be equal to or smaller than 4% of the total heat transfer amount. A heat transfer amount by solid conduction heat defined as a sum of the surface conduction heat ① and the supporter conduction heat ② is largest. For example, the heat transfer amount by the solid conduction heat may reach 75% of the total heat transfer amount. A heat transfer amount by the radiation transfer heat ④ is smaller than the heat transfer amount by the solid conduction heat but larger than the heat transfer amount of the gas conduction heat ③. For example, the heat transfer amount by the radiation transfer heat ④ may occupy about 20% of the total heat transfer amount.

According to such a heat transfer distribution, effective heat transfer coefficients (eK: effective K) (W/mK) of the surface conduction heat ①, the supporter conduction heat ②, the gas conduction heat ③, and the radiation transfer heat ④ may have an order of Math FIG. 1.

$$eK_{solidconductionheat} > eK_{radiationtransferheart} > ek_{gasconductionheat}$$ [Math FIG. 1]

Here, the effective heat transfer coefficient (eK) is a value that can be measured using a shape and temperature differences of a target product. The effective heat transfer coefficient (eK) is a value that can be obtained by measuring a total heat transfer amount and a temperature of at least one portion at which heat is transferred. For example, a calorific value (W) is measured using a heating source that can be quantitatively measured in the refrigerator, a temperature distribution (K) of the door is measured using heats respectively transferred through a main body and an edge of the door of the refrigerator, and a path through which heat is transferred is calculated as a conversion value (m), thereby evaluating an effective heat transfer coefficient.

The effective heat transfer coefficient (eK) of the entire vacuum adiabatic body is a value given by $k=QL/A\Delta T$. Here, Q denotes a calorific value (W) and may be obtained using a calorific value of a heater. A denotes a sectional area (m2) of the vacuum adiabatic body, L denotes a thickness (m) of the vacuum adiabatic body, and ΔT denotes a temperature difference.

For the surface conduction heat, a conductive calorific value may be obtained through a temperature difference (ΔT) between an entrance and an exit of the conductive resistance sheet 60 or 63, a sectional area (A) of the conductive resistance sheet, a length (L) of the conductive resistance sheet, and a thermal conductivity (k) of the conductive resistance sheet (the thermal conductivity of the conductive resistance sheet is a material property of a material and can be obtained in advance). For the supporter conduction heat, a conductive calorific value may be obtained through a temperature difference (ΔT) between an entrance and an exit of the supporting unit 30, a sectional area (A) of the supporting unit, a length (L) of the supporting unit, and a thermal conductivity (k) of the supporting unit.

Here, the thermal conductivity of the supporting unit is a material property of a material and can be obtained in advance. The sum of the gas conduction heat ③, and the radiation transfer heat ④ may be obtained by subtracting the surface conduction heat and the supporter conduction heat from the heat transfer amount of the entire vacuum adiabatic body. A ratio of the gas conduction heat ③, and the radiation transfer heat ④ may be obtained by evaluating radiation transfer heat when no gas conduction heat exists by remarkably lowering a vacuum degree of the vacuum space part 50.

When a porous material is provided inside the vacuum space part 50, porous material conduction heat ⑤ may be a sum of the supporter conduction heat ② and the radiation transfer heat ④. The porous material conduction heat ⑤ may be changed depending on various variables including a kind, an amount, and the like of the porous material.

According to an embodiment, a temperature difference ΔT1 between a geometric center formed by adjacent bars 31 and a point at which each of the bars 31 is located may be preferably provided to be less than 0.5° C. Also, a temperature difference ΔT2 between the geometric center formed by the adjacent bars 31 and an edge portion of the vacuum adiabatic body may be preferably provided to be less than 0.5° C. In the second plate member 20, a temperature difference between an average temperature of the second plate and a temperature at a point at which a heat transfer path passing through the conductive resistance sheet 60 or 63 meets the second plate may be largest.

For example, when the second space is a region hotter than the first space, the temperature at the point at which the heat transfer path passing through the conductive resistance sheet meets the second plate member becomes lowest. Similarly, when the second space is a region colder than the first space, the temperature at the point at which the heat transfer path passing through the conductive resistance sheet meets the second plate member becomes highest.

This means that the amount of heat transferred through other points except the surface conduction heat passing through the conductive resistance sheet should be controlled, and the entire heat transfer amount satisfying the vacuum adiabatic body can be achieved only when the surface conduction heat occupies the largest heat transfer amount. To this end, a temperature variation of the conductive resistance sheet may be controlled to be larger than that of the plate member.

Physical characteristics of the parts constituting the vacuum adiabatic body will be described. In the vacuum adiabatic body, a force by vacuum pressure is applied to all of the parts. Therefore, a material having a strength (N/m2) of a certain level may be preferably used.

Under such circumferences, the plate members 10 and 20 and the side frame 70 may be preferably made of a material having a sufficient strength with which they are not damaged by even vacuum pressure. For example, when the number of bars 31 is decreased so as to limit the support conduction heat, deformation of the plate member occurs due to the vacuum pressure, which may be a bad influence on the external appearance of refrigerator. The radiation resistance sheet 32 may be preferably made of a material that has a low emissivity and can be easily subjected to thin film processing. Also, the radiation resistance sheet 32 is to ensure a strength high enough not to be deformed by an external impact. The supporting unit 30 is provided with a strength high enough to support the force by the vacuum pressure and endure an external impact, and is to have machinability. The conductive resistance sheet 60 may be preferably made of a material that has a thin plate shape and can endure the vacuum pressure.

In an embodiment, the plate member, the side frame, and the conductive resistance sheet may be made of stainless materials having the same strength. The radiation resistance sheet may be made of aluminum having a weaker strength that the stainless materials. The supporting unit may be made of resin having a weaker strength than the aluminum.

Unlike the strength from the point of view of materials, analysis from the point of view of stiffness is required. The stiffness (N/m) is a property that would not be easily deformed. Although the same material is used, its stiffness may be changed depending on its shape. The conductive resistance sheets 60 or 63 may be made of a material having a predetermined strength, but the stiffness of the material is preferably low so as to increase heat resistance and minimize radiation heat as the conductive resistance sheet is uniformly spread without any roughness when the vacuum pressure is applied. The radiation resistance sheet 32 requires a stiffness of a certain level so as not to contact another part due to deformation. Particularly, an edge portion of the radiation resistance sheet may generate conduction heat due to drooping caused by the self-load of the radiation resistance sheet. Therefore, a stiffness of a certain level is required. The supporting unit 30 requires a stiffness high enough to endure a compressive stress from the plate member and an external impact.

In an embodiment, the plate member and the side frame may preferably have the highest stiffness so as to prevent deformation caused by the vacuum pressure. The supporting unit, particularly, the bar may preferably have the second highest stiffness. The radiation resistance sheet may preferably have a stiffness that is lower than that of the supporting unit but higher than that of the conductive resistance sheet.

The conductive resistance sheet may be preferably made of a material that is easily deformed by the vacuum pressure and has the lowest stiffness. Even when the porous material 33 is filled in the vacuum space part 50, the conductive resistance sheet may preferably have the lowest stiffness, and the plate member and the side frame may preferably have the highest stiffness.

Hereinafter, a vacuum pressure preferably determined depending on an internal state of the vacuum adiabatic body will be described. As already described above, a vacuum pressure is to be maintained inside the vacuum adiabatic body so as to reduce heat transfer. At this time, it will be easily expected that the vacuum pressure is preferably maintained as low as possible so as to reduce the heat transfer.

The vacuum space part 50 may resist the heat transfer by applying only the supporting unit 30. Alternatively, the porous material 33 may be filled together with the supporting unit in the vacuum space part 50 to resist the heat transfer. Alternatively, the vacuum space part may resist the heat transfer not by applying the supporting unit but by applying the porous material 33.

The case where only the supporting unit is applied will be described. FIG. 5 illustrates graphs showing changes in adiabatic performance and changes in gas conductivity with respect to vacuum pressures by applying a simulation. Referring to FIG. 5, it can be seen that, as the vacuum pressure is decreased, i.e., as the vacuum degree is increased, a heat load in the case of only the main body (Graph 1) or in the case where the main body and the door are joined together (Graph 2) is decreased as compared with that in the case of the typical product formed by foaming polyurethane, thereby improving the adiabatic performance. However, it can be seen that the degree of improvement of the adiabatic performance is gradually lowered. Also, it can be seen that, as the vacuum pressure is decreased, the gas conductivity (Graph 3) is decreased.

However, it can be seen that, although the vacuum pressure is decreased, the ratio at which the adiabatic performance and the gas conductivity are improved is gradually lowered. Therefore, it is preferable that the vacuum pressure is decreased as low as possible. However, it takes long time to obtain excessive vacuum pressure, and much cost is consumed due to excessive use of a getter. In the embodiment, an optimal vacuum pressure is proposed from the above-described point of view.

FIG. 6 illustrates graphs obtained by observing, over time and pressure, a process of exhausting the interior of the vacuum adiabatic body when the supporting unit is used. Referring to FIG. 6, in order to create the vacuum space part 50 to be in the vacuum state, a gas in the vacuum space part 50 is exhausted by a vacuum pump while evaporating a latent gas remaining in the parts of the vacuum space part 50 through baking. However, if the vacuum pressure reaches a certain level or more, there exists a point at which the level of the vacuum pressure is not increased any more (Δt1).

After that, the getter is activated by disconnecting the vacuum space part 50 from the vacuum pump and applying heat to the vacuum space part 50 (Δt2). If the getter is activated, the pressure in the vacuum space part 50 is decreased for a certain period of time, but then normalized to maintain a vacuum pressure of a certain level. The vacuum pressure that maintains the certain level after the activation of the getter is approximately 1.8×10^(−6) Torr. In the embodiment, a point at which the vacuum pressure is not substantially decreased any more even though the gas is exhausted by operating the vacuum pump is set to the lowest limit of the vacuum pressure used in the vacuum adiabatic body, thereby setting the minimum internal pressure of the vacuum space part 50 to 1.8×10^(−6) Torr.

FIG. 7 illustrates graphs obtained by comparing vacuum pressures and gas conductivities. Referring to FIG. 7, gas conductivities with respect to vacuum pressures depending on sizes of a gap in the vacuum space part 50 are represented as graphs of effective heat transfer coefficients (eK). Effective heat transfer coefficients (eK) were measured when the gap in the vacuum space part 50 has three sizes of 2.76 mm, 6.5 mm, and 12.5 mm.

The gap in the vacuum space part 50 is defined as follows. When the radiation resistance sheet 32 exists inside vacuum space part 50, the gap is a distance between the radiation resistance sheet 32 and the plate member adjacent thereto. When the radiation resistance sheet 32 does not exist inside vacuum space part 50, the gap is a distance between the first and second plate members.

It can be seen that, since the size of the gap is small at a point corresponding to a typical effective heat transfer coefficient of 0.0196 W/mK, which is provided to an adiabatic material formed by foaming polyurethane, the vacuum pressure is 2.65×10^(−1) Torr even when the size of the gap is 2.76 mm. Meanwhile, it can be seen that the point at which reduction in adiabatic effect caused by gas conduction heat is saturated even though the vacuum pressure is decreased is a point at which the vacuum pressure is approximately 4.5×10^(−3) Torr. The vacuum pressure of 4.5×10^(−3) Torr can be defined as the point at which the reduction in adiabatic effect caused by gas conduction heat is saturated. Also, when the effective heat transfer coefficient is 0.1 W/mK, the vacuum pressure is 1.2×10^(−2) Torr.

When the vacuum space part 50 is not provided with the supporting unit but provided with the porous material, the size of the gap ranges from a few micrometers to a few hundredths of micrometers. In this case, the amount of radiation heat transfer is small due to the porous material even when the vacuum pressure is relatively high, i.e., when the vacuum degree is low. Therefore, an appropriate vacuum pump is used to adjust the vacuum pressure. The vacuum pressure appropriate to the corresponding vacuum pump is approximately 2.0×10^(−4) Torr.

Also, the vacuum pressure at the point at which the reduction in adiabatic effect caused by gas conduction heat is saturated is approximately 4.7×10^(−2) Torr. Also, the pressure where the reduction in adiabatic effect caused by gas conduction heat reaches the typical effective heat transfer coefficient of 0.0196 W/mK is 730 Torr. When the supporting unit and the porous material are provided together in the vacuum space part, a vacuum pressure may be created and used, which is middle between the vacuum pressure when only the supporting unit is used and the vacuum pressure when only the porous material is used.

FIG. 8 is a section view of the door of FIG. 1, and FIG. 9 is an enlarged view of FIG. 8. Referring to FIGS. 8 and 9, the door 3 may include a vacuum adiabatic body 100 and a shielding part (or shield) 62 provided at an edge of the vacuum adiabatic body 100.

The vacuum adiabatic body 100 may include, as parts that enables a vacuum space part to be separated from an external atmospheric space, a first plate member (or first plate) 10, a second plate member (or second plate) 20, a conductive resistance sheet 60, and a side frame 70. The vacuum adiabatic body 100 may include a supporting unit (or support) 30 for maintaining a distance between the first plate member 10 and the second plate member 20, and the supporting unit 30 may include a bar 31.

The side frame 70 may be formed in a bent shape. One side of the side frame 70 may be connected to the conductive resistance sheet 60, and the other side of the side frame 70 may be connected to the second plate member 20.

The second plate member 20 and the conductive resistance sheet 60 may be coupled to the side frame 70 through welding. The side frame 70 is shielded by the shielding part 62, thereby insulating heat.

In the refrigerator, cold air passing through the conductive resistance sheet 60 is transferred to the side frame 70. The temperature of the side plate 70 is formed relatively higher than that of the first plate member 10.

The shielding part 62 shields an upper portion of the conductive resistance sheet 60, thereby heat-insulating the conductive resistance sheet 60. Meanwhile, a lower portion of the conductive resistance sheet 60 may be heat-insulated by the vacuum space part 50. The shielding part 62 may be formed along the edge of the vacuum adiabatic body 100.

The shielding part 62 may include a porous material, etc. so as to improve an adiabatic effect. Specifically, the shielding part 62 may include a polyurethane material.

A gasket 90 may be provided at an upper end of the shielding part 62. The gasket 90 blocks a gap between the door 3 and the main body 2, thereby blocking convection heat transfer between the interior and exterior of the refrigerator. A lower end of the shielding part 62 contacts the conductive resistance sheet 60 at at least one portion, and the upper end of the shielding part 62 contacts the gasket 90.

The conductive resistance sheet 60 is disposed at a position A1 at which it overlaps with the shielding part 62, which is effective in heat insulation. If the conductive resistance sheet 60 is out of the position A1, the adiabatic effect may be decreased.

Furthermore, if the conductive resistance sheet 60 is disposed at a position A2 at which it overlaps with the gasket 90, the adiabatic effect may be further increased. A result obtained by analyzing heat transfer with respect to positions of the conductive resistance sheet 60 will be described in detail with reference to FIG. 10.

A curved surface depressed toward the vacuum space part 50 is formed in the conductive resistance sheet 60. At this time, the curved surface is disposed at the position A2 at which it overlaps with the gasket 90, which is most preferable from the point of view of heat insulation.

Although not shown in these figures, the conductive resistance sheet 60 may include a sealing part for fastening the conductive resistance sheet 60 to the first plate member 10. In this case, the sealing part may be disposed at the position A2 at which it overlaps with the gasket 90.

Meanwhile, when the vacuum adiabatic body at the side of the main body 2 is closed with respect to the vacuum adiabatic body at the side of the door 3, the conductive resistance sheet 60 provided in the door 3 is shielded by the vacuum adiabatic body provided in the main body 2, thereby insulating heat. In this case, adiabatic performance can be optimized when the conductive resistance sheet 60 provided in the door 3 is disposed at a position at which it overlaps with the vacuum adiabatic body provided in the main body 2.

On the contrary, the conductive resistance sheet provided in the main body 2 is shielded by the door 3, thereby insulating heat. In this case, adiabatic performance can be optimized when the conductive resistance sheet provided in the main body is disposed at a position at which it overlaps with the vacuum adiabatic body 60 provided in the door 3.

Hereinafter, a result obtained by analyzing heat transfer with respect to positions of the conductive resistance sheet 60 will be described. FIG. 10 is a view showing a result obtained by analyzing heat transfer when the conductive resistance sheet is disposed at an outside of the shielding part.

Referring to FIG. 10, it can be seen that, when the conductive resistance sheet 60 is disposed at the outside of the shielding part, the temperature of a portion of the outer surface of the shielding part 62 is lowered. Specifically, it can be seen through the analysis that a middle point of a side portion of the shielding part 62 has a lower temperature than other portions. Also, it can be seen that the temperature of a front portion of the shielding part 62 is lowered as the front portion reaches from the left side to the right side.

This is because cold air in the refrigerator is transferred to the exterior as the adiabatic performance between the first plate member 10 and the second plate member 20 is degraded. If the temperature of the outer surface of the shielding part 62 is lowered to fall to a dew point, a dew condensation phenomenon may occur, and therefore, a customer's inconvenience may be caused.

Hereinafter, a structure for heat-insulating the conductive resistance sheet 60 placed at the outside of the shielding part 62 will be described. FIG. 11 is a sectional view of a door according to another embodiment. This embodiment is different from the above-described embodiment only in the shielding part and the conductive resistance sheet, and therefore, overlapping descriptions will be omitted.

Referring to FIG. 11, the door of this embodiment includes a first plate member 10, a second plate member 20, a supporting unit 30, a conductive resistance sheet 60, and a side frame 70. A shielding part 62 may be provided at the periphery of the side frame 70, and a gasket 90 may be provided at an upper side of the shielding part 62.

The conductive resistance sheet 60 is disposed at an outside of the shielding part 62. That is, the conductive resistance sheet 60 may be exposed to the interior of the refrigerator. However, the shielding part 62 may include an adiabatic extending part (or adiabatic extension) 162.

The adiabatic extending part 162 is formed to extend toward the inside of the first plate member 10 from the shielding part 62, thereby shielding the conductive resistance sheet 60. That is, the separate adiabatic extending part 162 is added without deforming the shielding part 62, so that it is possible to shield the conductive resistance sheet 60. The conductive resistance sheet 60 is shielded by the adiabatic extending part 162, so that it is possible to improve the adiabatic performance of the vacuum adiabatic body.

FIGS. 12 to 14 are views showing results obtained by analyzing heat transfer with respect to positions of the conductive resistance sheet. FIG. 12 illustrates a case where the conductive resistance sheet is disposed inside the shielding part, FIG. 13 illustrates a case where the conductive resistance sheet is disposed at a position at which it overlaps with the gasket, and FIG. 14 illustrates a case where the conductive resistance sheet overlaps with the shielding part but does not overlap with the gasket.

Referring to FIG. 12, there is shown a temperature gradient when the conductive resistance sheet 60 is disposed at an inside of the shielding part 62, i.e., position A1. In FIG. 12, it can be seen that the temperature gradient of the shielding part 62 is formed with a uniform thickness. That is, it can be seen that, as the conductive resistance sheet 60 is heat-insulated, cold air in the refrigerator is prevented from being transferred to the exterior.

Referring to FIG. 13, there is shown a temperature gradient when the conductive resistance sheet 60 is disposed at a position at which it overlaps with the gasket 90 while being disposed at the inside of the shielding part 62. That is, there is shown a temperature gradient when the conductive resistance sheet 60 is disposed at position A2.

It can be seen that the temperature of the outer surface of the shielding part 62 is uniform even when the conductive resistance sheet 60 is disposed at the position at which it overlaps with the gasket 90. That is, it can be seen that, as the conductive resistance sheet 60 is heat-insulated, cold air in the refrigerator is prevented from being transferred to the exterior.

The case of FIG. 13 will be compared with the case of FIG. 12. In the case of FIG. 13, the temperature gradient is rapidly changed in the vicinity of the conductive resistance sheet 60. On the other hand, in the case of FIG. 12, the temperature gradient is gently changed in the vicinity of the conductive resistance sheet 60. That the temperature gradient is rapidly changed means that heat transfer in the vicinity of the conductive resistance sheet 60 is limited as much as the change in temperature gradient. Accordingly, the adiabatic performance can be estimated.

In the case of FIG. 13, the range in which the temperature is constantly maintained toward the inside from the outer surface of the shielding part 62 is wide. On the other hand, in the case of FIG. 12, the range in which the temperature is constantly maintained toward the inside from the outer surface of the shielding part 62 is narrow.

Referring to FIG. 14, there is a temperature gradient when the conductive resistance sheet 60 is disposed inside the shielding part 62. However, unlike the case of FIG. 12, FIG. 14 illustrates a case where the conductive resistance sheet 60 is disposed at a position distant from the gasket 90.

In this case, it can be seen that cold air is infiltrated deeply into the inside of the shielding part 62. Also, it can be seen that a temperature gradient occurs at an outer surface of the side portion of the shielding part 62. That is, it can be seen that the temperature of the surface is not uniform. Therefore, a dew condensation phenomenon may occur due to a temperature difference on an outer surface of the second plate member 20.

FIGS. 15 and 16 are graphs showing minimum temperatures of the outer surface of the second plate member with respect to relative positions of the conductive resistance sheet. Referring to FIGS. 15 and 16, it can be seen that a minimum temperature distribution of temperatures of the outer surface of the second plate member 20 when the conductive resistance sheet 60 is disposed at a position (first position) at which it overlaps with the gasket 90 is similar to a minimum temperature distribution of temperatures of the outer surface of the second plate member 20 when the conductive resistance sheet 60 is disposed at a position (second position) at which it is disposed in the shielding part 62 but does not overlap with the gasket 90.

However, it can be seen that, for some points, the temperature of the outer surface of the second plate member 20 when the conductive resistance sheet 60 is disposed at the second position is lower than the temperature of the outer surface of the second plate member 20 when the conductive resistance sheet 60 is disposed at the first position. Meanwhile, it can be seen that a temperature of the outer surface of the second plate member 20 when the conductive resistance sheet 60 is disposed at a position (third position) at which it is exposed in the refrigerator is remarkably low as compared with when the conductive resistance sheet 60 is disposed at the first position and when the conductive resistance sheet 60 is disposed at the second position. If the temperature of the outer surface of the second plate member 20 becomes lower than the dew point of air as it is lowered, dew may be condensed on the outer surface of the second plate member 20.

In the graph of FIG. 15, there is shown a dew point at a temperature of 32° C. and a relative humidity (RH) of 85%. It can be seen that, when the conductive resistance sheet 60 is disposed at the third position, surface temperatures falls to the dew point or less at some points of the outer surface of the second plate member 20. As described above, it is possible to prevent a phenomenon in which the temperature of the outer surface of the second plate member 20 is lowered by the cold air in the refrigerator by changing the position of the conductive resistance sheet 60.

FIG. 17 is a sectional view of a door according to still another embodiment. Referring to FIG. 17, the door according to the embodiment may include a first plate member (or first plate) 110, a second plate member (or second plate) 120, a conductive resistance sheet 160, a side frame 170, and a gasket 190.

One side of the conductive resistance sheet 160 may be connected to the first plate member 110, and the other side of the conductive resistance sheet 160 may be connected to the side frame 170. The side frame 170 may be connected to the second plate member 120 at an outermost portion thereof. The side frame 170 may be coupled to the second plate member 120 through welding.

The side frame 170 may be formed in a bent shape. Specifically, the side frame 170 may be provided such that the height of an edge portion of the side frame 170 is lowered when viewed from the entire shape of the vacuum adiabatic body.

The conductive resistance sheet 160 may be mounted on a portion at which the height of the side frame 170 is high to be coupled to the side frame 170. The side frame 170 and the conductive resistance sheet 160 may be coupled to each other through welding.

An additional mounting part 180 may be mounted on a portion at which the height of the side frame 170 is low. A door hinge, an exhaust portion, etc. may be mounted on the addition mounting part 180. Accordingly, it is possible to maximally ensure the internal volume of a product such as the refrigerator provided by the vacuum adiabatic body, to improve an adiabatic effect, and to sufficiently ensure functions of the product.

The gasket 190 may completely shield the conductive resistance sheet 160. A protruding part 193 provided in the gasket 190 may be inserted in a space between the side frame 170 and the addition mounting part 180. Also, the gasket 190 may be mounted on a portion of the addition mounting part 180.

A length d1 of the portion at which the height of the side frame 170 is high may be formed longer than a length d2 from an edge portion of the first plate member 110 to an inner end of the gasket 190. That is, the gasket 190 is disposed at a position biased toward the side frame 170 so as to prevent cold air from being transferred from the first plate member 110 to the conductive resistance sheet 160. Similarly, a contact area between the gasket 190 and the side frame 170 may be formed wider than that between the gasket 190 and the first plate member 110.

The vacuum adiabatic body proposed in the present disclosure may be preferably applied to refrigerators. However, the application of the vacuum adiabatic body is not limited to the refrigerators, and may be applied in various apparatuses such as cryogenic refrigerating apparatuses, heating apparatuses, and ventilation apparatuses.

According to the present disclosure, the vacuum adiabatic body can be industrially applied to various adiabatic apparatuses. The adiabatic effect can be enhanced, so that it is possible to improve energy use efficiency and to increase the effective volume of an apparatus.

The invention claimed is:

1. A vacuum adiabatic body comprising:

a first plate defining at least one portion of a first side of a wall adjacent to a first space having a first temperature;

a second plate defining at least one portion of a second side of the wall adjacent to a second space having a second temperature different from the first temperature, the second side of the wall being nearer to the second space than the first side of the wall;

a seal that seals the first plate and the second plate to provide a third space that has a third temperature between the first temperature and the second temperature and is in a vacuum state;

a support that supports the first and second plates and is provided in the third space;

an exhaust port through which a gas in the third space is exhausted;

a conductive resistance sheet having a first end connected to the first plate, the conductive resistance sheet configured to resist heat transfer between the second plate and the first plate; and a gasket that heat-insulates the conductive resistance sheet, wherein a first surface of the conductive resistance sheet is heat-insulated by a shield provided adjacent to the conductive resistance sheet, and a second surface of the conductive resistance sheet is heat-insulated by the third space.

2. The vacuum adiabatic body according to claim 1, wherein a first surface of the shield contacts the conductive resistance sheet, and a second surface of the shield contacts the gasket.

3. The vacuum adiabatic body according to claim 2, wherein at least one portion of the conductive resistance sheet overlaps with the gasket.

4. The vacuum adiabatic body according to claim 2, wherein the conductive resistance sheet is depressed into the third space, and overlaps with the gasket.

5. The vacuum adiabatic body according to claim 2, further including a seal that fastens the conductive resistance sheet to the first plate, wherein the seal is provided such that the conductive resistance sheet overlaps with the gasket.

6. The vacuum adiabatic body according to claim 1, wherein the shield includes a porous material.

7. The vacuum adiabatic body according to claim 1, wherein the shield includes an adiabatic material made of a polyurethane material.

8. The vacuum adiabatic body according to claim 1, further including a side frame connected to a second end of the conductive resistance sheet, wherein the side frame is connected to the second plate.

9. The vacuum adiabatic body according to claim 8, wherein the side frame is shielded by the shield.

10. The vacuum adiabatic body according to claim 1, wherein the shield includes an adiabatic extension that extends toward a center of the first plate, the adiabatic extension shielding the conductive resistance sheet.

11. The vacuum adiabatic body according to claim 1, wherein the shield includes a gasket.

12. The vacuum adiabatic body according to claim 11, wherein a contact area between the gasket and the side frame is wider than a contact area between the gasket and the first plate.

13. A vacuum adiabatic body comprising:

a first plate defining at least one portion of a first side of a wall adjacent to a first space having a first temperature;

a second plate defining at least one portion of a second side of the wall adjacent to a second space having a second temperature different from the first temperature, the second side of the wall being nearer to the second space than the first side of the wall;

a seal that seals the first plate and the second plate to provide a third space that has a third temperature between the first temperature and the second temperature and is in a vacuum state;

a support that supports the first and second plates and is provided in the third space;

an exhaust port through which a gas in the third space is exhausted;

a conductive resistance sheet having a first end connected to the first plate, the conductive resistance sheet configured to resist heat transfer between the second plate and the first plate, wherein a thickness of the conductive resistance sheet is thinner than the first and second plates, and a shield that heat insulates the conductive resistance sheet is provided at an outside of the conductive resistance sheet.

14. The vacuum adiabatic body according to claim 13, wherein solid conduction heat between the first plate and the second plate is greater than radiation transfer heat, and gas conduction heat between the first plate and the second plate is smaller than the radiation transfer heat.

15. The vacuum adiabatic body according to claim 13, further including a gasket provided adjacent to the shield, wherein the gasket heat-insulates the conductive resistance sheet.

16. A refrigerator comprising:

a main body including an internal space in which goods are stored; and a door provided to open and close the main body, wherein, in order to supply a refrigerant into the main body, the refrigerator includes:

a compressor that compresses the refrigerant;

a condenser that condenses the compressed refrigerant;

an expander that expands the condensed refrigerant; and an evaporator that evaporates the expanded refrigerant to transfer heat, wherein at least one of the main body and the door includes a vacuum adiabatic body, wherein the vacuum adiabatic body includes:

a first plate defining at least one portion of a first side of a wall adjacent to the internal space having a first temperature;

a second plate defining at least one portion of a second side of the wall adjacent to an external space having a second temperature different from the first temperature;

a seal that seals the first plate and the second plate to provide a vacuum space that has a third temperature between the first temperature of the internal space and the second temperature of the external space and is in a vacuum state;

a support that maintains the vacuum space;

a conductive resistance sheet that decreases a heat transfer amount between the first plate and the second plate; and an exhaust port through which a gas in the vacuum space is exhausted, wherein a shield that heat-insulates the conductive resistance sheet is provided at an outside of the conductive resistance sheet.

17. The refrigerator according to claim 16, wherein the shield includes a gasket to block a gap between the main body and the door.

18. The refrigerator according to claim 17, wherein at least one portion of the conductive resistance sheet overlaps with the gasket.

19. The refrigerator according to claim 16, wherein the conductive resistance sheet provided in the door is shielded by the door to insulate heat.

20. The refrigerator according to claim 19, wherein the main body includes an adiabatic body, and the conductive resistance sheet overlaps with the adiabatic body within an extending line of the adiabatic body provided in the main body.

* * * * *